US007056267B2

(12) United States Patent
Demas

(10) Patent No.: US 7,056,267 B2
(45) Date of Patent: Jun. 6, 2006

(54) SYSTEM FOR CREATING A PERSONALIZED FITNESS VIDEO FOR AN INDIVIDUAL

(76) Inventor: Donald P. Demas, 45 Fowler Ave., Cortlandt Manor, NY (US) 10567

( * ) Notice: Subject to any disclaimer, the term of this patent is extended or adjusted under 35 U.S.C. 154(b) by 505 days.

(21) Appl. No.: 10/615,200

(22) Filed: Jul. 8, 2003

(65) Prior Publication Data

US 2005/0019735 A1 Jan. 27, 2005

(51) Int. Cl.
*A63B 21/00* (2006.01)

(52) U.S. Cl. ..... 482/90

(58) Field of Classification Search ..... 482/1–9, 482/90, 900, 902; 434/247, 257; 704/271
See application file for complete search history.

(56) References Cited

U.S. PATENT DOCUMENTS 5,836,770 A * 11/1998 Powers ..... 434/247
6,468,086 B1 * 10/2002 Brady-Koontz ..... 434/257
6,728,680 B1 * 4/2004 Aaron et al. ..... 704/271

* cited by examiner

*Primary Examiner*—Glenn E. Richman
(74) *Attorney, Agent, or Firm*—Bucknam and Archer; Joseph J. Orlando

(57) ABSTRACT

A physical fitness professional assesses an individual for whom a personalized fitness video is to be created with respect to flexibility, cardiovascular condition, body fat composition, muscular strength and condition, as well as other health conditions and limitations. Based on this assessment a specific fitness plan is determined and which includes a detailed workout program of specific exercises in at least one sequential arrangement. The physical fitness professional selects a plurality of video segments from a series of video segments stored in a computer wherein each selected video segment is a specific exercise of the detailed workout program and arranges the selected video segments into a sequence corresponding to the sequential arrangement of specific exercises of the specific fitness plan and records the same on a digital versatile disc or video cassette tape or makes the selected video segments of the specific fitness plan available on a secure web site.

11 Claims, 1 Drawing Sheet

SYSTEM FOR CREATING A PERSONALIZED FITNESS VIDEO FOR AN INDIVIDUAL

FIELD OF THE INVENTION

The present invention relates to a system or method for creating a personalized fitness video for an individual and, more particularly, it relates to such a system or method whereby a fitness expert, after determining a specific fitness plan for the individual, utilizes a computer to create a video for a personalized fitness program based on the determined specific fitness plan so that the individual for whom the video is created can follow the program by playing the video and following the instructions thereof or accessing a secure web site established by the fitness expert which contains the video.

BACKGROUND OF THE INVENTION

There are at the present time a number of fitness, exercise or workout videos available on the market. Several are produced by well-known personalities, such as Jane Fonda, Denise Austin and Richard Simmons. Other such physical fitness videos include martial arts exercise videos, etc. The underlying rationale of such fitness/exercise videos is to inspire and instruct individuals in the performance of a series of exercises designed to achieve the intended goal which is the premise of the particular video, i.e. fitness, weight loss, martial arts proficiency, etc. Thus, the fitness or exercise expert will demonstrate on the video a series of exercises with voice instructions which in that expert's opinion are generally suitable for achieving the particular goal desired. Since each such video must of necessity be addressed to a relatively wide audience without regard to any individual's physical abilities, physical needs or physical goals, a relatively large segment of the population who could potentially benefit from such a fitness/exercise program is effectively excluded. For instance, individuals with everyday problems and health issues, such as lower back problems, knee problems, high blood pressure, etc., are to a large extent precluded from participating in the exercise programs of such generic fitness/exercise videos since such generic fitness videos are incapable of addressing everyone's fitness level. Furthermore, such generic fitness/exercise videos include minimal, if any, modifications necessary to decrease the possibility of further injury to a participant with an already existing health condition or limitation.

For those individuals who wish to exercise in the privacy of their own homes and who are physically limited because of a health problem or condition and thus unable to utilize the generic fitness/exercise videos currently available, the services of a fitness expert or trainer for in-home training is required. Obviously, the employment of such a personal trainer for one or several sessions per week is expensive and certainly not within the means of many physically limited individuals who are unable to utilize the generic fitness/exercise videos.

SUMMARY OF THE INVENTION

It is, therefore, a primary object of the present invention to provide a system whereby a fitness expert can produce a personalized fitness video for an individual which takes into account that individual's physical abilities, physical needs and physical goals.

The above object is accomplished in accordance with the present invention whereby the individual for whom the fitness video is intended is assessed by the physical fitness expert for the individual's flexibility, cardiovascular condition, body fat composition, muscular strength and endurance, and other health conditions or limitations. Based on this assessment, the physical fitness expert determines a specific fitness plan which includes a detailed workout program of specific exercises. The physical fitness expert then, by means of operations performed on a computer, selects a plurality of video segments each of which demonstrates a specific exercise of the detailed workout program in accordance with the determined specific fitness plan. These video segments are among a series of pre-recorded video segments stored in a library memory of the central processing unit. The physical fitness expert then, by means of further operations on the computer, arranges the selected video segments into a sequence corresponding to at least one arrangement of the specific exercises according to the specific fitness plan and possibly into several different arrangements. Then, by means of a DVD burner, the physical fitness expert records the sequentially arranged selected video segments onto a digital versatile disc (DVD) which can then be utilized by the individual in his personal computer or DVD player for personalized physical fitness instruction.

For those individuals who prefer a video tape rather than a DVD, the physical fitness expert can record a videotape of the personalized fitness program from the DVD.

In addition, the physical fitness expert can upload the sequentially arranged selected video segments of the specific fitness plan for an individual onto a web site which can then be made available for downloading by the individual. When the individual has downloaded the selected video components into his or her computer, the video can be viewed on screen.

BRIEF DESCRIPTION OF THE DRAWINGS

Other objects and features of the present invention will become apparent from the following detailed description considered in connection with the accompanying drawings, in which.

DETAILED DESCRIPTION OF THE INVENTION

Figure 1:
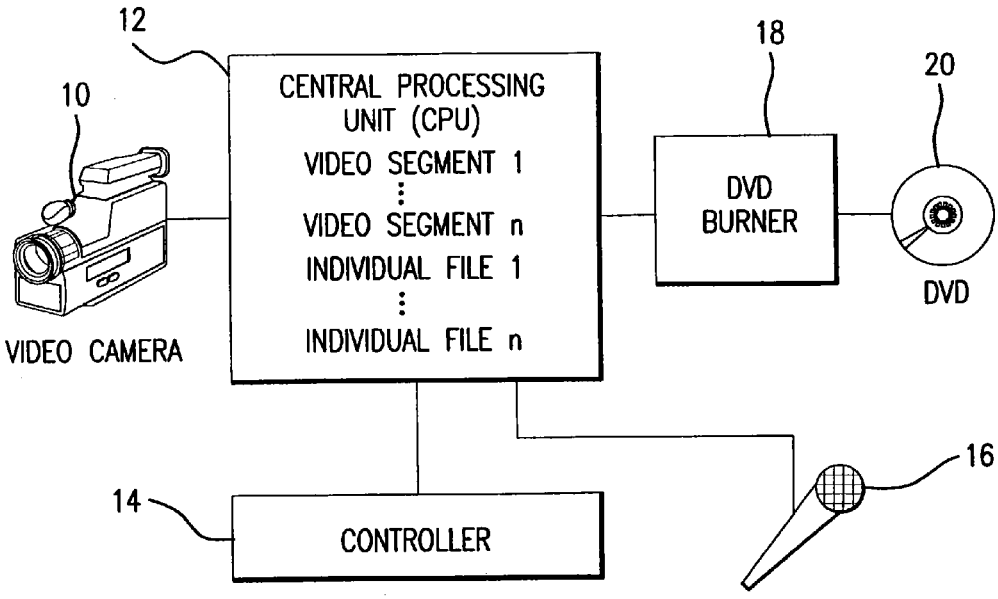
FIG. 1 is a schematic representation of the apparatus utilized in the system for producing a personalized fitness video on a digital versatile disc for an individual according to the present invention.

Initially, the physical fitness professional will pre-record a series of video segments 1 to n utilizing a video camera, designated 10 in FIG. 1. Each pre-recorded video segment of the series is a video demonstration of a specific exercise and/or variations of specific exercises. Thus, video segment 1 may demonstrate the push-up exercise, video segment 2 may demonstrate the deep knee bend, video segment 3 may demonstrate a typical warm-up exercise and so on. Included in the series of video segments 1 to n will also be video segments of exercises designed to address specific handicaps and physical problems or limitations. The recorded video segments 1 to n are recorded in the memory of a central processing unit 12 and stored therein. Subsequently, the physical fitness professional by operations performed on controller 14 and utilizing microphone 16, will insert voice over instructions as well as printed instructions on each of the video segments as necessary. Such instructions may further explain the demonstrated exercise or caution the viewer with respect to the exercise in order to avoid a possibility of injury.

The physical fitness professional can now proceed to produce a customized or personalized physical fitness video for an individual when approached to do so. First, the physical fitness professional interviews the individual desiring the personalized fitness video and assesses the individual's flexibility, cardiovascular condition, body fat composition, muscular strength and endurance. Any other health conditions or limitations that the individual may have are also taken into consideration by the physical fitness professional. Based on this assessment and taking into consideration the individual's needs and goals, the physical fitness professional determines a specific fitness plan which will include a detailed workout program of specific exercises. The fitness professional then returns to his or her computer and by utilizing controller 14 selects a video segment from the series of video segments 1 to n stored in central processing unit 12 for each specific exercise of the detailed workout program and arranges the selected video segments into one or more sequences corresponding to the specific fitness plan.

At this stage the fitness professional, utilizing microphone 16, can amend the voice over instructions associated with each selected video segment or insert totally new instructions as required for the benefit of the individual for whom the video is being created.

The resulting specific fitness plan is fixed in a file specific to the individual for whom it is created and stored in central processing unit 12 as individual file 1. Subsequent files, individual files 2 to n, corresponding to specific fitness plans for other individuals will also be stored in central processing unit 12 as those individuals are assessed and specific fitness plans developed.

Figure 2:
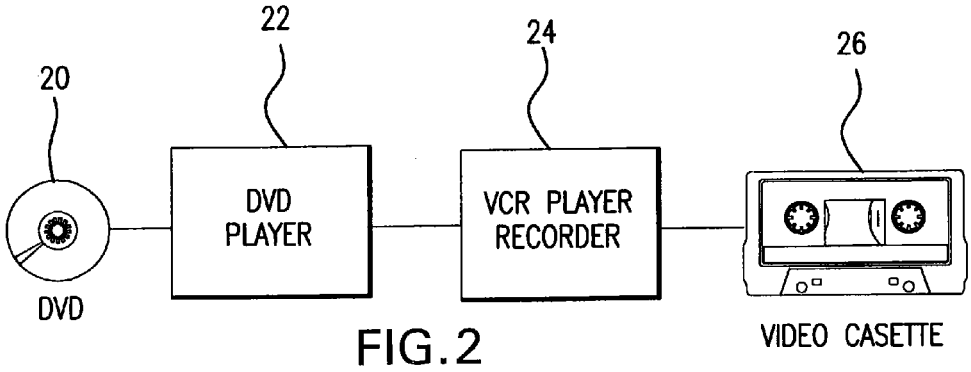
FIG. 2 is a schematic representation of the production of a video cassette of the personalized fitness video from a DVD thereof.

By means of DVD burner 18, a digital versatile disc (DVD) fitness video, designated 20, is created from the specific individual file stored in central processing unit 12. Thus, the individual for whom the fitness video is designed may utilize a personal computer for viewing and following the specific fitness plan or he may utilize a DVD player for viewing and following the specific fitness plan. On the other hand, if the individual wishes to have a video cassette of the fitness program made, as clearly seen in FIG. 2, DVD 20 is inserted into DVD player 22 to which a VCR player recorder 24 is connected and the video is recorded onto a blank video cassette resulting in a fitness video cassette 26.

Figure 3:
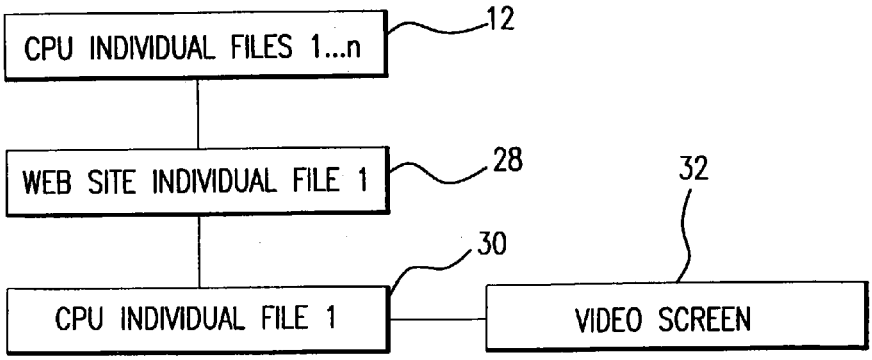
FIG. 3 is a schematic representation for the use of a secure web site for accessing a personalized fitness video.

Another option which can be made available to an individual for whom a specific fitness plan is developed and stored in central processing unit 12 as one of the individual files 1 to n is to permit access to the individual file via the internet. Thus, as clearly seen in FIG. 3, the fitness professional obtains a secure web site 28 from a web server and uploads, for instance, individual file 1 onto the web site which is then made available to the individual for whom the specific fitness plan of individual file 1 was developed. That individual will obtain an identification and password from the fitness professional so that he or she can download from web site 28 the video of individual file 1 into his or her computer or central processing unit 30 to be viewed on screen 32.

Subsequently, after the individual for whom the fitness video was designed has utilized the fitness video for a period of time, the physical fitness professional will reassess the individual so as to evaluate the progress made by the individual in following DVD fitness video 20, fitness video cassette 26 or secure web site 28. Based on this reassessment, the physical fitness professional may return to the file specific to this individual stored in central processing unit 12 and through controller 14 and microphone 16 make changes in the file as required. These changes may include additional specific exercises from video segments 1 to n and/or deletion from the file of certain specific exercises, changes to the voice over or printed instructions, sequence changes, etc. which, in the opinion of the physical fitness professional, are necessary or required.

It is to be understood that the foregoing general and detailed descriptions are explanatory of the present invention and are not to be interpreted as restrictive of the scope of the following claims.

What is claimed is:

1. A system for creating a personalized fitness video for an individual, comprising:

a) assessing said individual's flexibility, cardiovascular condition, body fat composition, muscular strength and condition, and other health conditions and limitations;

b) determining a specific fitness plan based on the assessment derived in step (a) and taking into consideration said individual's needs and goals, said specific fitness plan including a detailed workout program of specific exercises in at least one sequential arrangement of specific exercises;

c) selecting by operations performed on a computer a plurality of video segments from a series of video segments stored in a library memory of said computer wherein each of the video segments of said selected plurality of video segments is a specific exercise of said detailed workout program of specific exercises;

d) arranging in said computer the video segments of said selected plurality of video segments into a sequence corresponding to said at least one sequential arrangement of specific exercises of said specific fitness plan; and e) recording said at least one sequential arrangement of selected video segments onto a digital versatile disc by means of a DVD burner in said computer.

2. The system for creating a personalized fitness video for an individual as defined in claim 1, wherein each video segment of said series of video segments stored in a library memory of said computer is a specific exercise previously recorded by means of a video camera and permanently stored in the library memory of the computer for later retrieval.

3. The system for creating a personalized fitness video for an individual as defined in claim 2, wherein each video segment of said series of video segments stored in the library memory of said computer includes voice over and/or printed instructions for performing the exercise inputted to the video segment by operations performed on the computer and including a microphone.

4. The system for creating a personalized fitness video for an individual as defined in claim 1, wherein the sequentially arranged selected video segments are fixed in a file specific to said individual and stored in the library memory of the computer for later retrieval.

5. The system for creating a personalized fitness video for an individual as defined in claim 1, which further comprises transferring the at least one sequential arrangement of selected video segments recorded on said digital versatile disc to a video cassette.

6. A system for creating a personalized fitness video for an individual, comprising:

a) assessing said individual's flexibility, cardiovascular condition, body fat composition, muscular strength and condition, and other health conditions and limitations;

b) determining a specific fitness plan based on the assessment derived in step (a) and taking into consideration said individual's needs and goals, said specific fitness plan including a detailed workout program of specific exercises in at least one sequential arrangement of specific exercises;

c) selecting by operations performed on a first computer a plurality of video segments from a series of video segments stored in a library memory of said first computer wherein each of the video segments of said selected plurality of video segments is a specific exercise of said detailed workout program of specific exercises;

d) arranging in said first computer the video segments of said selected plurality of video segments into a sequence corresponding to said at least one sequential arrangement of specific exercises of said specific fitness plan;

e) uploading said sequentially arranged selected plurality of video segments onto a secure web site; and f) downloading from said secure web site by said individual said sequentially arranged selected plurality of video segments into a second computer.

7. The system for creating a personalized fitness video for an individual as defined in claim 6, wherein each video segment of said series of video segments stored in a library memory of said first computer is a specific exercise previously recorded by means of a video camera and permanently stored in the library memory of the first computer for later retrieval.

8. The system for creating a personalized fitness video for an individual as defined in claim 7, wherein each video segment of said first series of video segments stored in the library memory of said first computer includes voice over and/or printed instructions for performing the exercise inputted to the video segment by operations performed on the first computer and including a microphone.

9. The system for creating a personalized fitness video for an individual as defined in claim 6, wherein the sequentially arranged selected video segments are fixed in a file specific to said individual and stored in the library memory of said first computer for later retrieval.

10. A digital versatile disc of a personalized fitness video for an individual produced according to the system defined in claim 1.

11. A video cassette of a personalized fitness video for an individual produced according to the system defined in claim 5.

* * * * *